US006089447A

United States Patent [19]

Sin et al.

[11] Patent Number: 6,089,447

[45] Date of Patent: Jul. 18, 2000

[54] BOX BLANKS CONTAINING EASY-OPENING TABS

[76] Inventors: Woo H. Sin; Anne K. Sin, both of 14213 Cribbage Ter., Silver Spring, Md. 20904

[21] Appl. No.: 09/166,743

[22] Filed: Oct. 5, 1998

[51] Int. Cl.[7] ..... B65D 5/42

[52] U.S. Cl. ..... 229/125.39; 229/160.2; 229/125.37; 493/84

[58] Field of Search ..... 229/123.1, 125.37, 229/125.39, 125.41, 160.2; 493/84, 378, 379, 380

[56] References Cited

U.S. PATENT DOCUMENTS

| | | | |
|---|---|---|---|
| 2,192,423 | 3/1940 | Ward et al. | 229/123.1 |
| 3,567,108 | 3/1971 | Corridon | 229/160.2 |
| 4,266,687 | 5/1981 | Cummings | 229/123.1 |
| 4,390,104 | 6/1983 | Cummings | 229/123.1 |
| 4,632,299 | 12/1986 | Holmberg | 229/123.1 |
| 5,184,997 | 2/1993 | James et al. | 229/125.39 |
| 5,465,900 | 11/1995 | Baratto et al. | 229/123.1 |

*Primary Examiner*—Gary E. Elkins
*Attorney, Agent, or Firm*—Richard L. Huff

[57] ABSTRACT

A blank for making a box contains a tab for simplifying the opening of the box once it is taped shut in the usual manner. The tab contains adhesive backing on its upper portion and a tab handle on its lower portion. When the box is taped shut, the tape covers the upper portion of the tab. To open the box, the tab is pulled up, releasing the upper portion of the tab and the accompanying tape. By further pulling, the entire tape may be removed from the box. The tab may be opened and closed a number of times.

16 Claims, 2 Drawing Sheets

BOX BLANKS CONTAINING EASY-OPENING TABS

BACKGROUND OF THE INVENTION

1. Field of the Invention

This invention is directed to box blanks and boxes having tabs attached thereto which will allow for simple opening and resealing of the boxes when the boxes have been sealed with adhesive tape.

2. Description of the Related Art

It is common knowledge in the art that conventional boxes contain four sides having upper and lower edges, a bottom, and a top having a center line and containing two inner flaps and two outer flaps. The outer flaps come into close proximity with each other near the center line when the boxes are closed. In order to seal such boxes, a strip of strong, sometimes reinforced, adhesive tape is applied. This tape generally runs from a point near the top of one side, along the center line of the top, and down the opposite side to a point near the top of that side. In many instances, a plurality of strips are applied to add additional strength to the seal. Conventionally, both ends of the tape are firmly adhered to the sides of the boxes. Opening the boxes by lifting the tape is extremely difficult and time-consuming. Therefore, clerks, stock personnel, or other end users resort to opening the boxes by cutting the tape with a variety of cutting devices. These cutting devices have sharp edges, which are dangerous to carry or to leave lying around. These cutting devices are also easy to lose. Until now, there has been no simple way to open boxes sealed as described above or to be able to open and reseal the boxes a multiplicity of times.

SUMMARY OF THE INVENTION

This invention seeks to solve the above-described problems by preparing boxes which contain tabs which will allow for easy opening and resealing of the sealed boxes. The tabs are composed of upper and lower portions. The upper portions are adhered to the boxes by means of a known adhesive which will allow for release and resealing. The lower portions serve as handles. The tabs are placed on box blanks in such a way that they will be at a top edge of a side at the end of the center line of the top. Preferably, the tabs are applied to the box blanks following construction and printing of the blanks and before the blanks are packaged for shipment.

DESCRIPTION OF THE PREFERRED EMBODIMENTS

The invention will now be described with reference to the above drawing, like numerals referring to like features throughout.

Figure 1:
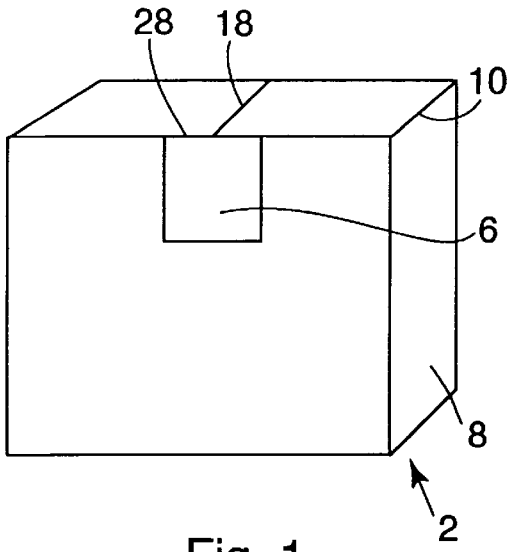
FIG. 1 is an elevational perspective view of a box having a tab of the present invention attached thereto.
Figure 4:
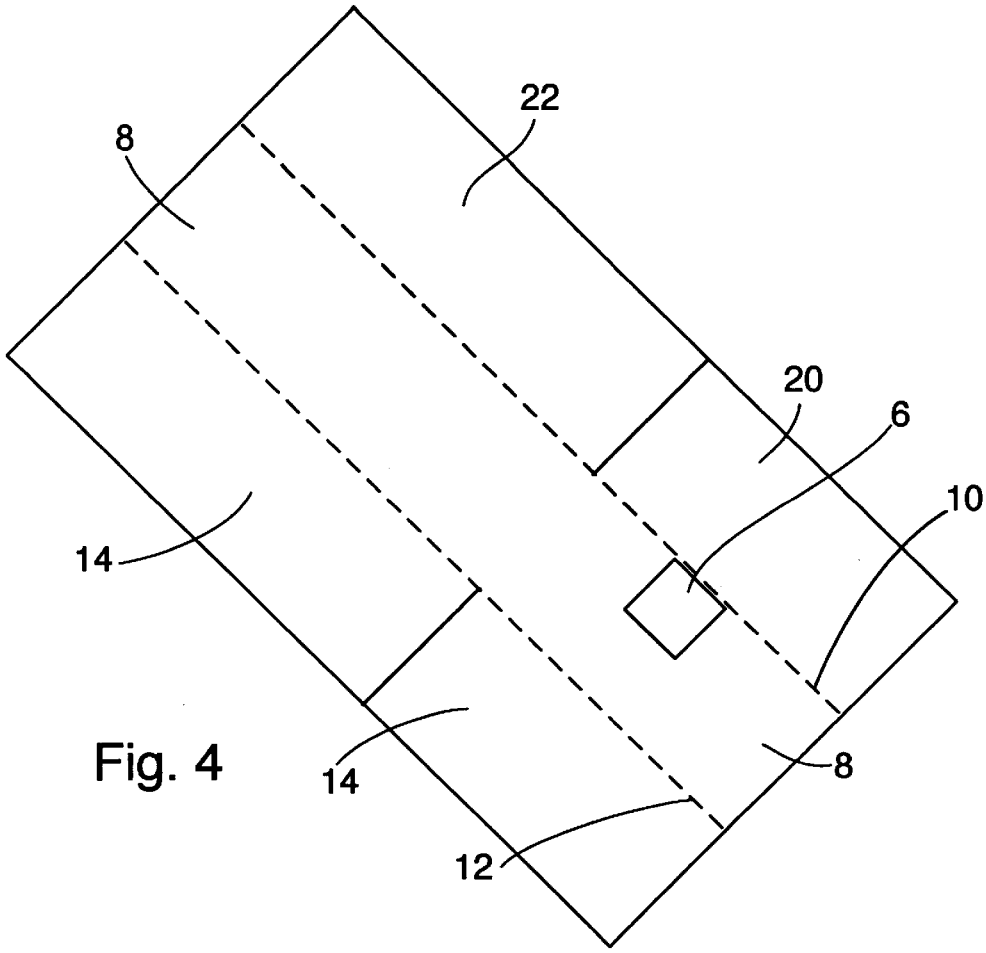
FIG. 4 is a top plan view of a box blank having a tab of this invention in place.

Referring to FIGS. 1 and 4, a box 2 and a box blank 4 having a tab 6 attached will be described.

During the manufacture of boxes 2, box blanks 4 are prepared which will result in boxes 2 having the required size and shape. Conventionally, a box 2 has four sides 8 having upper 10 and lower edges 12, a bottom 14, and a top 16 having a line joining 18. The box additionally has two inner flaps 20 and two outer flaps 22. Conventionally, the outer flaps 22 are of equal size and meet at the center along the joining line 18. It is understood, however, that the outer flaps 22 may be of different sizes and the joining line 18 will be to one side or the other of true center.

Following preparation of the blank 4 and before shipping to a company which will be filling the box 2, the box 2 is printed according to the instructions of the filling company.

According to the present invention, a tab 6 is placed on the box 2 at a time following manufacture of the blank 4. This may be prior to or after printing, preferably after printing. The tab 6 may be placed on the box 2 prior to or after shipping, preferably prior to shipping. If desired, the tab 6 may be placed on the box 2 after filing and prior to sealing. In another embodiment, the tab 6 may be put on the box 2 at the time of sealing.

Figure 2:
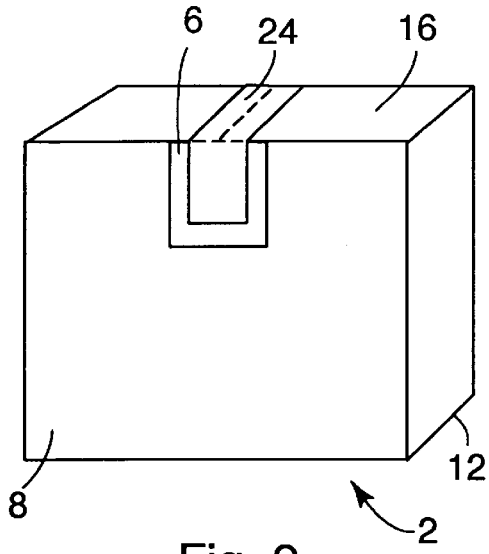
FIG. 2 is an elevational perspective view of a tabbed box according to FIG. 1 with sealing tape in place.

With reference to FIGS. 1 and 2, sealing of the box 2 will be described.

When the box 2 is filled, it is closed by bringing the outer flaps 22 into close proximity with each other at the joining line 18. The box 2 is then taped shut by starting tape 24 at the center of a first side (not shown) near the top thereof, bringing the tape 24 along the joining line 18 of the top 16 so that it holds down the two outer flaps 22, and bringing the tape 24 down a second side 8 opposite the first side so that it ends on the tab 6 in the center of the second side 8 near the upper edge 10 thereof.

The tab 6 of this invention will be discussed with reference to FIGS. 3 and 5–7.

The tab 6 of this invention is constructed so that it has an upper portion 26 having an upper edge 28 and a lower portion 30. The upper edge 28 of the upper portion 26 lies along the upper edge 10 of the side 8 of the box 2 to which the final portion 32 of tape 24 is applied. The upper portion 26 comprises a strip 34, a first side 36 of which has adhesive and a second side 38 of which has no adhesive. The first side 36 containing adhesive is applied to the side 8 of the box. The adhesive may be any suitable adhesive known in the art, but is preferably of the type known to be suitable for multiple sealing and release operations. Thus, an adhesive having relatively low adhesive properties is preferred.

Figure 5:
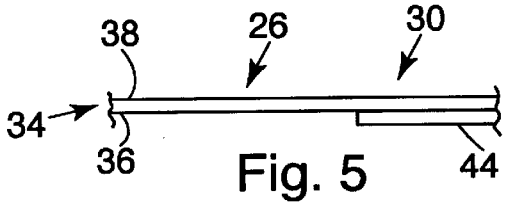
FIG. 5 is a side elevational view of one embodiment of a tab of this invention.
Figure 6:
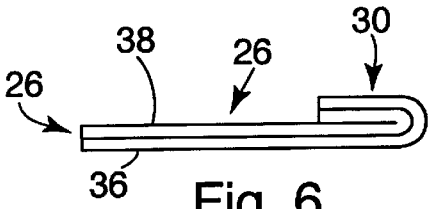
FIG. 6 is a side elevational view of a second embodiment of a tab of this invention.
Figure 7:
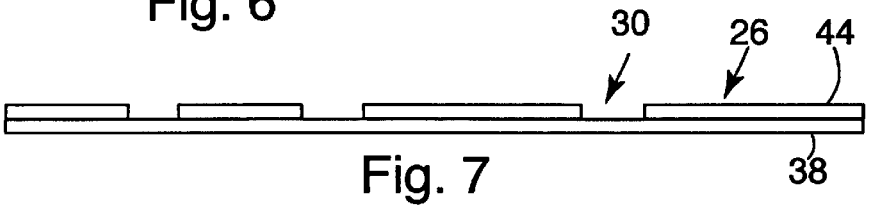
FIG. 7 is a side elevational view of a strip of tabs according to this invention.

The lower portion 30 of the tab 6 has no adhesive facing the side 8 of the box. In constructing the tab 6, a single strip 34 may be used and adhesive 42 may be applied to alternating sections as shown in FIG. 7. Another method of making the tab 6 as shown in FIG. 6 is to prepare an adhesive strip 34 of relatively short length and to fold a portion of the strip 34 upon itself so as to prepare an upper portion 26 having exposed adhesive 42 and a lower portion 30 having no exposed adhesive. A third method of preparing the tab 6 as shown in FIG. 5 is to prepare an adhesive strip 34 and to adhere a layer of material 44 to alternating sections of that strip to prepare a strip 34 having alternating sections of exposed adhesive and solid material 44. The material 44 may be of any suitable type, and is preferably cloth, cardboard, or paper.

In another embodiment of this invention, the tab 6 may be prepared after filling the box and during the time of sealing. One end of the tape 24 used in sealing the box 2 may be folded back upon itself to prepare a handle (lower portion) 30 as shown in FIG. 6 which is devoid of any exposed adhesive. Thus, the tape 24 and the tab 6 are of one piece. Also, the sealing tape 24 may be adhered to a piece of material 44 which serves as a handle (lower portion) 30 as shown in FIG. 5. Again, cloth, cardboard, and paper are preferred materials 44.

Figure 3:
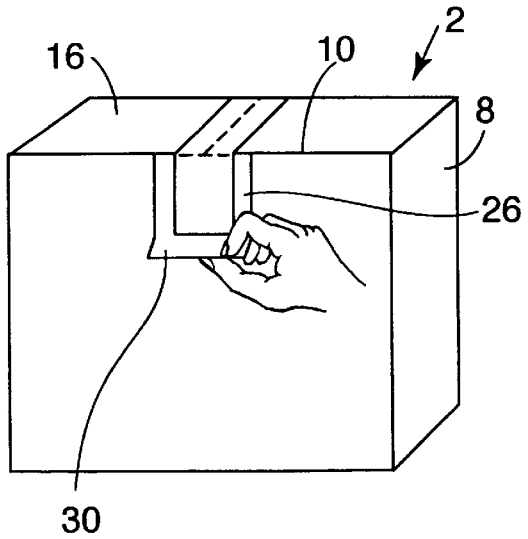
FIG. 3 is an elevational perspective view of a tabbed and sealed box, showing how the tape may be released.

The opening of the sealed box 2 will now be described with reference to FIG. 3.

Following filling of the box 2 and sealing the box so that the adhesive tape 24 along the joining 18 of the top 16 is attached to the outer surface of the upper portion 26 of the tab 6, the adhesive tape 24 may be easily removed without cutting by simply lifting the tab 6. As this is done, the attached adhesive tape 24 is lifted off the side 8 of the box 2. Continued pulling of the handle 30 results in the removal of the tape 24 from the joining line 18 of the top 16 of the box 2.

If desired, the tape 24 may be replaced and the tab 6 readhered to the side 8 of the box 2, thus resealing the box 2. This operation may be repeated a multiplicity of times.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. In the method of making blanks for boxes, which boxes contain four sides having upper and lower edges, a bottom, and a top having a joining line and containing two inner flaps and two outer flaps, the outer flaps coming into close proximity at the joining line of the top, the improvement comprising: attaching a tab having an upper portion containing adhesive on one side and a lower portion which serves as a handle to a portion of the blank which will be at the upper edge of one of the sides which will be at the end of the joining line of the top.

2. The method of claim 1, wherein the tab is a tab which is prepared by bending a strip of adhesive tape upon itself to form an upper portion containing a single layer of adhesive tape and a lower portion containing two layers of adhesive tape adhered together.

3. The method of claim 1, wherein the tab is a tab which is prepared by attaching a strip of adhesive tape to a layer of material so as to form an upper portion containing a single layer of adhesive tape and a lower portion containing a layer of adhesive tape adhered to a layer of material.

4. The method of claim 3, wherein the material is cloth.

5. The method of claim 3, wherein the material is cardboard.

6. The method of claim 3, wherein the material is paper.

7. In a blank for making boxes, which boxes contain four sides having upper and lower edges, a bottom, and a top having a joining line and containing two inner flaps and two outer flaps, the outer flaps coming into close proximity at the joining line of the top, the improvement comprising: a tab having an upper portion containing adhesive on one side and a lower portion which serves as a handle adhered to a portion of the blank which will be at the upper edge of one of the sides which will be at the end of the joining line of the top.

8. The blank of claim 7, wherein the tab is a tab which is prepared by attaching a strip of adhesive tape to a layer of material so as to form an upper portion containing a single layer of adhesive tape and a lower portion containing a layer of adhesive tape adhered to a layer of material.

9. The blank of claim 8, wherein the material is cloth.

10. The blank of claim 8, wherein the material is cardboard.

11. The blank of claim 8, wherein the material is paper.

12. In a box, which box contains four sides having upper and lower edges, a bottom, and a top having a joining line and containing two inner flaps and two outer flaps, the outer flaps coming into close proximity at the joining line of the top, the improvement comprising: a tab having an upper portion containing adhesive on one side and a lower portion which serves as a handle adhered to a portion of the box which is at the upper edge of a second side at the end of the joining line of the top such that when the box is filled, it may be closed by bringing the outer flaps into close proximity with each other at the joining line, and the box may then be taped shut by starting the tape near the top of a first side which is opposite from the second side, bringing the tape along the joining line of the top so that it holds down the two outer flaps, and bringing the tape down the second side so that it ends on the tab and near the upper edge of the tab.

13. The box of claim 12, wherein the tab is a tab which is prepared by attaching a strip of adhesive tape to a layer of material so as to form an upper portion containing a single layer of adhesive tape and a lower portion containing a layer of adhesive tape adhered to a layer of material.

14. The box of claim 13, wherein the material is cloth.

15. The box of claim 13, wherein the material is cardboard.

16. The box of claim 13, wherein the material is paper.

* * * * *